United States Patent [19]

Nimke et al.

[11] Patent Number: 4,602,752

[45] Date of Patent: Jul. 29, 1986

[54] STACKABLE CABLE REEL

[75] Inventors: Helmut E. Nimke, Tuxedo; Ronald P. Brigando, Brooklyn, both of N.Y.

[73] Assignee: Brooklyn Union Gas Company, Brooklyn, N.Y.

[21] Appl. No.: 533,959

[22] Filed: Sep. 20, 1983

[51] Int. Cl.[4] ..... B65H 49/02; B65D 21/02; B65D 85/04

[52] U.S. Cl. ..... 242/129; 206/515

[58] Field of Search ..... 242/105, 118.1, 129.5, 242/137, 136, 139, 129, 138, 167, 118.4, 118.41; 206/515, 516, 517, 518, 519, 520; 191/12.4, 12.2 A, 12.2 R

[56] References Cited

U.S. PATENT DOCUMENTS

| | | | |
|---|---|---|---|
| 2,081,331 | 5/1937 | Hathaway | 242/118.41 |
| 2,197,180 | 4/1940 | Jenne et al. | 242/129 |
| 2,283,710 | 5/1942 | Waterbury | 242/167 |
| 3,374,319 | 3/1968 | Stahmer | 191/12.2 R |
| 3,430,886 | 3/1969 | Sweeney | 242/118.41 |
| 3,602,455 | 8/1971 | Lewis | 242/138 |
| 3,902,679 | 9/1975 | Bost | 242/129 |
| 4,240,554 | 12/1980 | Bock | 206/519 |

FOREIGN PATENT DOCUMENTS

| | | | |
|---|---|---|---|
| 84217 | 1/1958 | Denmark | 242/118.41 |

*Primary Examiner*—Harvey C. Hornsby
*Assistant Examiner*—Scott J. Haugland
*Attorney, Agent, or Firm*—Fitzpatrick, Cella, Harper & Scinto

[57] ABSTRACT

A stackable cable carrying reel has spaced parallel rings connected by exterior spokes arranged to permit a plurality of reels to be stacked, locking devices being provided to enable each reel to be locked to its next adjacent reel. Each reel has structure permitting an end of its cable to be connected a power supply.

4 Claims, 8 Drawing Figures

Fig. 5.
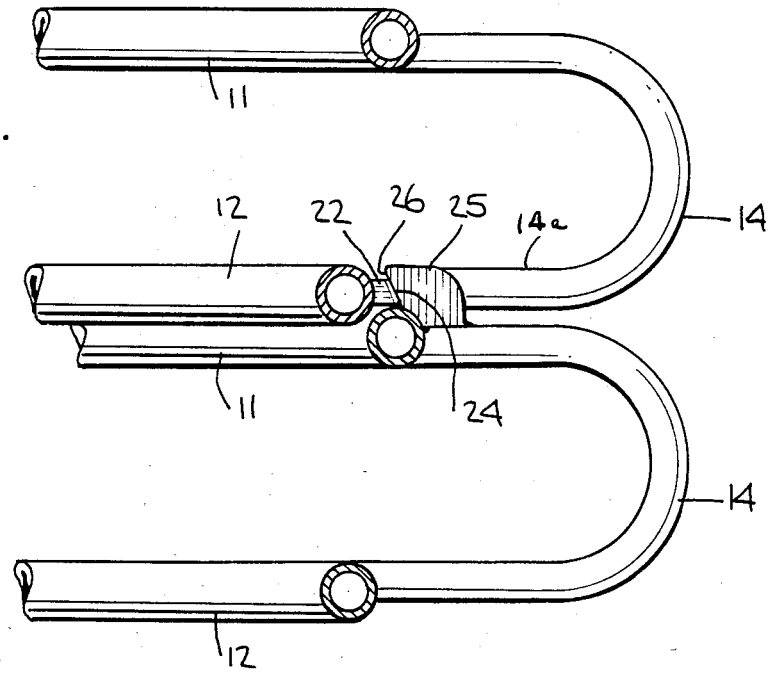
Fig. 8.
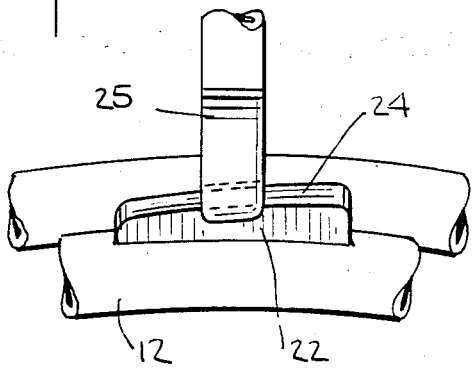
Fig. 6.
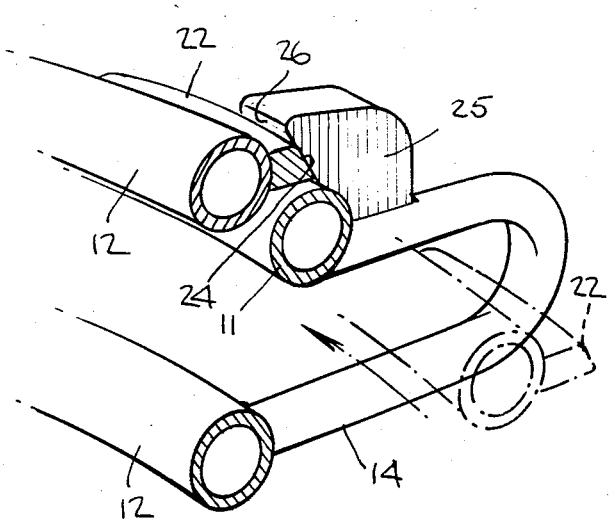
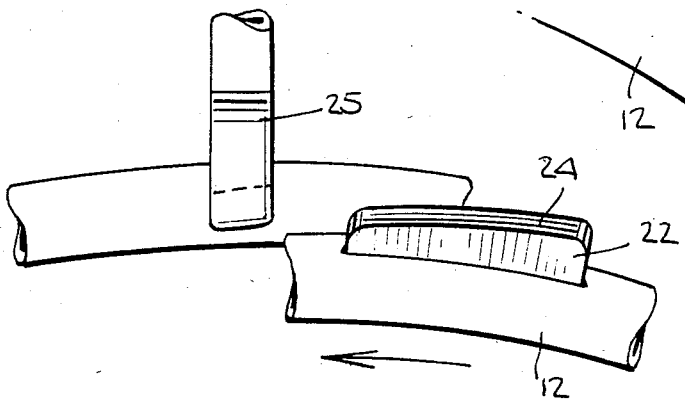
Fig. 7.

STACKABLE CABLE REEL

BACKGROUND OF THE INVENTION

1. Field of the Invention

This invention relates to cable or snake reels and more particularly, to such reels which may be stacked and secured relative to one another.

2. Description of the Prior Art

Heretofore, where a job required several different cables to be delivered to the job site, it was known to provide a cable carrier formed of as many as three or four reels integrally joined to provide a single unit, each reel being adapted to carry a separate cable. Each cable was wound in a reel so that one end could be peeled from the interior of the winding to deliver power to a particular tool connected thereto. Such carriers were necessarily bulky and heavy so that they were often provided with frames which included legs upon which wheels were mounted to enable the carriers to be transported to and from the work site with the common central axis of the reels in horizontal attitude.

We have found such carriers inconvenient for transportation to and from certain work sites. For example, where the site is in the basement of a building it is difficult and sometimes impossible to transport the known carrier through doorways, down stair cases and the like, and to use the cables and the tools connected to them where the space at the site is confining.

SUMMARY OF THE INVENTION

We have conceived and contribute by the present invention a stackable cable reel by which we are able to overcome the foregoing difficulties and disadvantages.

Thus, according to one aspect of the present invention, we provide a cable reel comprising a pair of spaced, parallel rings, a plurality of carrier spokes connected to each of said rings and extending outwardly thereof and locking means fixed to the rings whereby the reels may be keyed to one another in stacked disposition. We prefer that the spokes be U-shaped members, the legs of which are connected respectively to one of the rings and extend outwardly, away from the central axis of the reel, in planes parallel to the planes of the respective rings and that the locking means comprise a key secured to one of the rings and formed with an inclined surface, and a lug secured to the other ring and also formed with an inclined surface. By reason of this construction the rings are firmly supported in spaced relation by the spokes which may also receive turns of cable wound in the reel, and adjacent reels may be locked together by bringing the inclined surface of the key on one reel into mating engagement with the inclined surface of the lug on an adjacent reel.

It will be appreciated that, by the foregoing construction, any number of reels may be stacked, preferably vertically, and locked together so that the first reel becomes a stand for the next adjacent reel and stabilizes the same, and so forth. To this end, the diameter of one of the rings of each reel is greater than that of the other ring and the spokes are of a smaller outside dimension than that of the rings so that when reels are stacked, the ring of smaller diameter may nest within the ring of larger diameter of an adjacent reel and the spokes will not interfere with the nesting rings; rather, the portion of the spokes connected to the smaller diameter ring of one reel will rest on the larger diameter ring of the adjacent reel.

According to a further aspect of the invention, we provide a support extending between the outer portions of two adjacent spokes six of which are preferably provided spaced 60° apart. This support may comprise an arcuate, semi-tubular element having a center of curvature coincident with that of the rings and corresponding to the contour of the bights of the adjacent spokes to which it is connected. An opening is formed in the support for a purpose later to be described.

Since the spokes are positioned exterior of the rings rather than interior thereof and are configured as described, it will be appreciated that the inner terminal end of each cable wound in a reel, and which is to be connected to a tool or device requiring electrical or motive power, may be peeled from the interior of its reel without interference by the spokes and that the spokes act, not only to maintain the rings spaced apart but also to receive turns of the wound cable.

The present construction permits only those individual cable carrying reels as needed to be conveniently transported to the work site, stacked and locked together to form a stable assembly at the site, and readily to be unlocked and individually removed from the site upon completion of the job.

The reels are preferably formed of aluminum, the rings and spokes being of tubular form to provide lightweight but strong reels each of which may be manually carried by one man.

To assemble a stack of reels, a first reel may be placed on its side, preferably horizontally, that is, with its central axis vertical and its ring of greater diameter on the top, and the next reel is placed on the first in the same attitude and with its key adjacent the lug on the first reel so that by rotating the uppermost reel a slight annular distance, the inclined faces of the key and lug come into mating engagement to key or lock the reels together. Additional reels may be similarly added, as needed.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Specific embodiments of the invention have been chosen for purposes of illustration and description, and are shown in the accompanying drawings, forming a part of the specification wherein:

FIG. 5 is a partial assembly view illustrating two reels locked together; and

FIGS. 6, 7 and 8 are detail views showing the key and lug arrangement, FIG. 6 being a sectional view in perspective showing the key and lug in locked disposition, FIG. 7 illustrating the key and lug in unlocked disposition and FIG. 8 being a partial plan view illustrating the key and lug in locked condition.

DESCRIPTION OF THE PREFERRED EMBODIMENT

Figure 1:
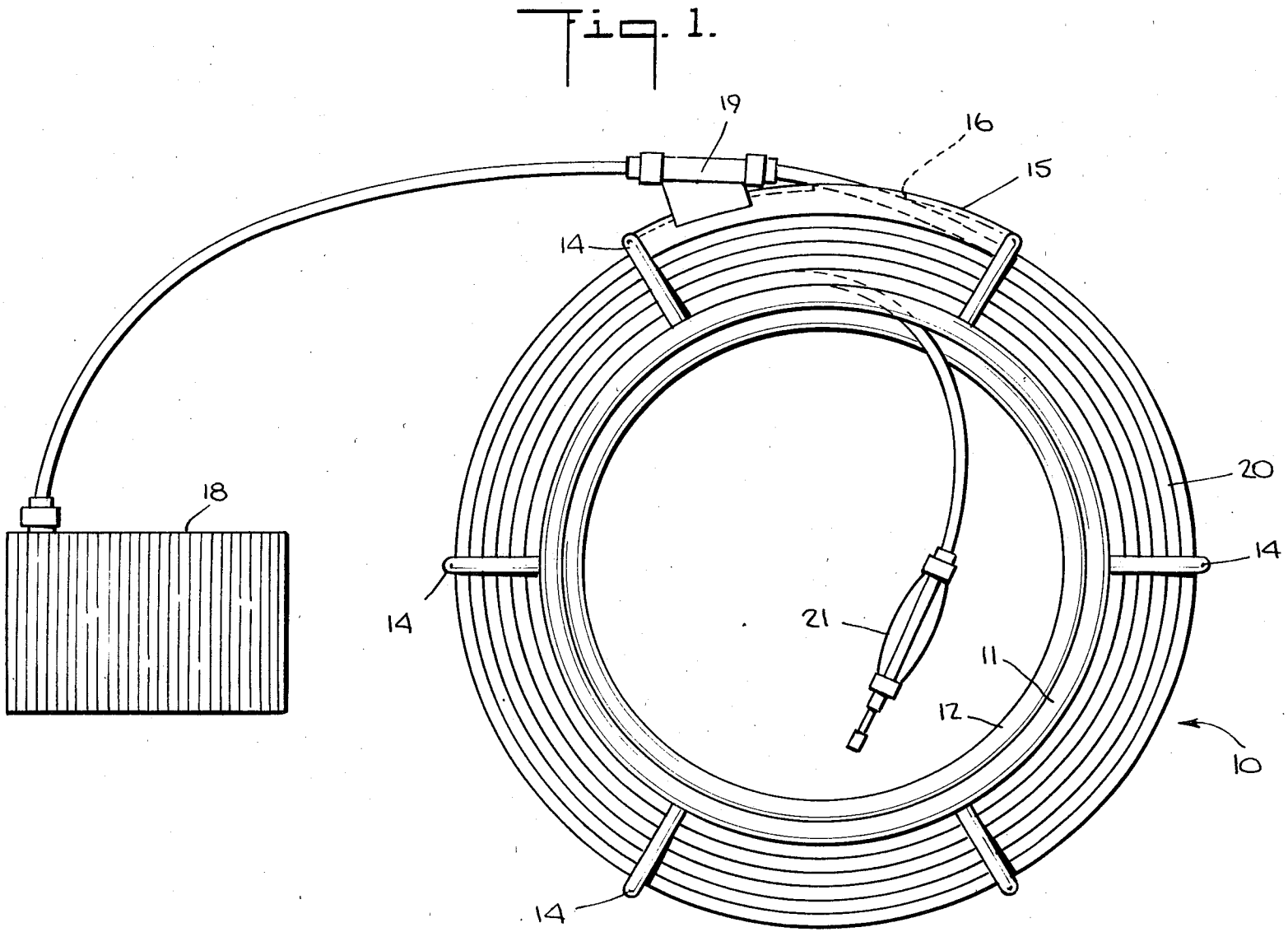
FIG. 1 is a top plan view of a reel according to the present invention and illustrating a cable carried therein with one end connected to a tool and the other to a rotary motive power transition box.
Figure 3:
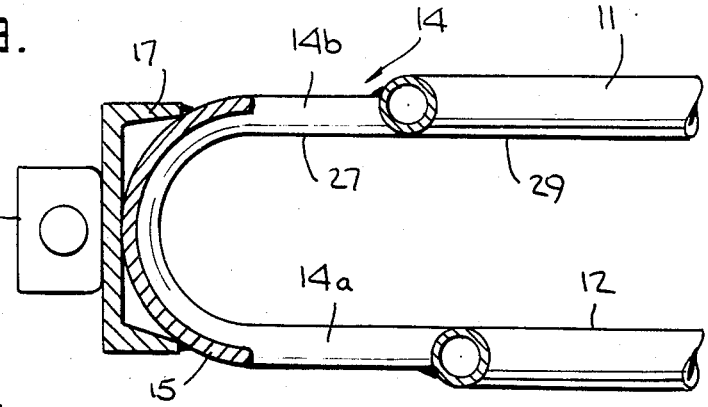
FIG. 3 is a cross-sectional view taken along the line 3—3 of FIG. 2.
Figure 4:
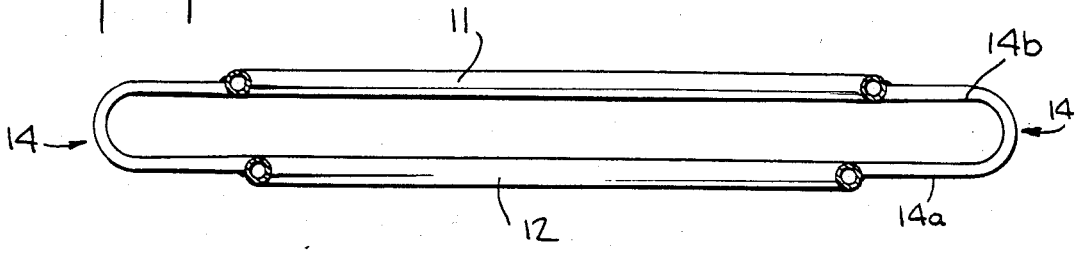
FIG. 4 is an elevational sectional view of a reel according to the present invention illustrating the structural relationship between the rings and the spokes.

Referring to the drawing and particularly to FIG. 1, there is shown a plan view of a reel 10 according to the present invention. A top ring 11 is vertically spaced from and partially overlies a concentric lower ring 12 which is of slightly smaller diameter than the top ring. Six spokes 14, of U-shaped configuration, as shown in FIG. 3, extend radially outwardly of the rings and have their legs secured as by welding to respective of the rings. Thus, as seen in FIGS. 3 and 4, each spoke 14 is formed with a long leg 14*a* connected to the lower ring 12 and a short leg 14*b* connected to the top ring 11.

Figure 2:
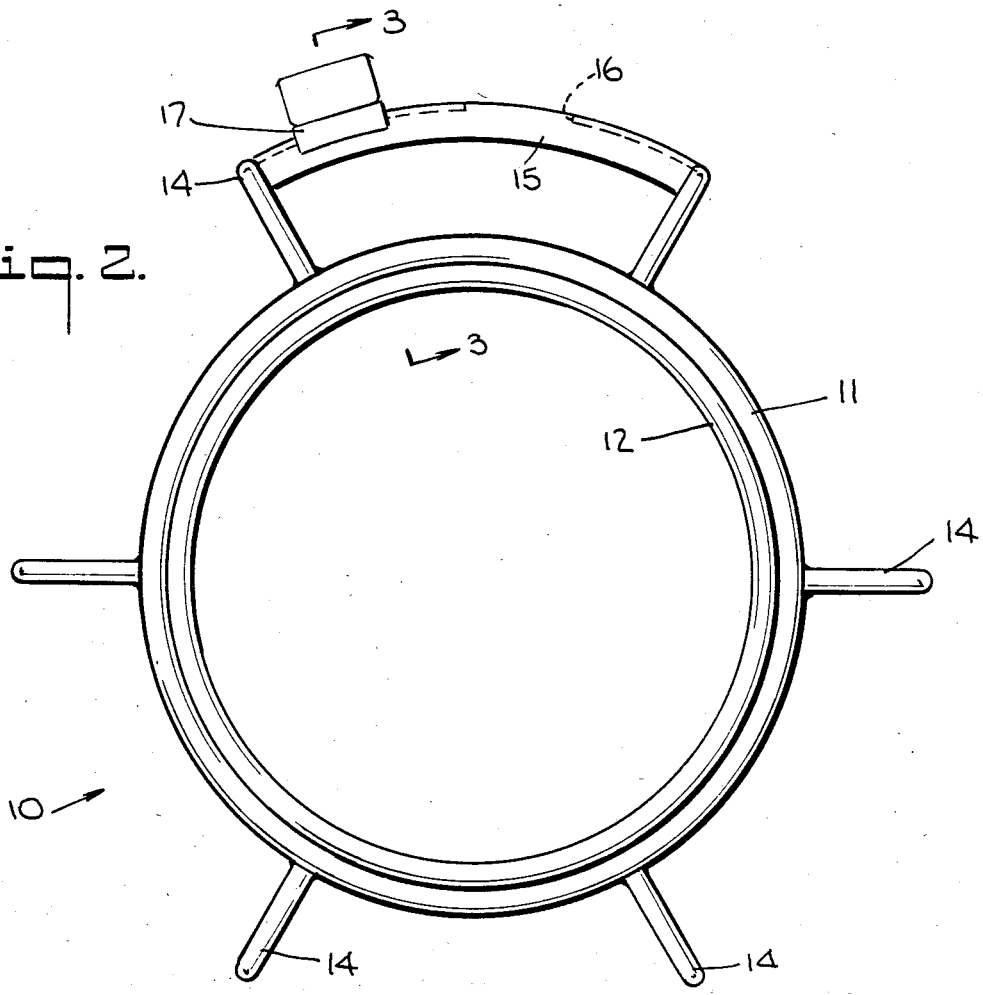
FIG. 2 is a view similar to FIG. 1 but without the cable to illustrate details of the cable guide and platform with an electrical transition box.

As shown in FIGS. 1, 2, and 3 we provide a support 15 extending between and fixed to the outer regions of two adjacent spokes. As stated, the support may take the form of an arcuate, semi-tubular element having a center of curvature coincident with that of the rings and corresponding substantially to the contour of the bights of the spokes and an opening 16 in its bight for a purpose later to be described.

A platform 17 is welded or otherwise secured to the outer surface of the support 15, as best shown in FIGS. 2 and 3, and carries a power transition box 19 which may enclose a mechanical coupling for transmitting rotary drive power from a conventional source thereof such as a Goodway drive 18, to the cable 20 (FIG. 1) to drive a rotatable tool 21, and the box on a second reel may enclose an electrical coupling for transmitting electrical power through a cable to a heater or the like at the inner end of the cable. Such box may, on other reels, provide connection for compressed gas or hydraulic power depending on the intended application.

Referring now to FIGS. 5, 6, 7 and 8, we illustrate the locking means by which adjacent reels may be removably secured together. Thus, a key 22 formed with a surface 24 inclined in two planes, as shown in FIGS. 6 and 6, is secured to the outer peripheral region of the ring 12 at a location centered between spokes, and a lug 25 having an inclined surface 26 corresponding to the surface 24 is fixed to the outer peripheral region of the ring 11, at a location on a spoke. Actually, we prefer that the surfaces 24 and 26 be inclined at an angle of the order of about 10° to a line tangent to the respective ring to which the key and lug are attached, at the center of the zone of contact thereof, and at an angle of the order of about 30° to the central axis of the reel. As already stated, adjacent reels may be keyed or locked together by positioning the first ring on the ground and stacking a second ring on the first so that rings 11 and 12 of the respective reels nest with each other with a key and lug adjacent one another. The uppermost ring is then rotated relative to the lowermost ring until the inclined surfaces of the key and lug are brought into mating engagement. Any desired number of reels may thus be stacked and locked to stabilize the assembly, each reel serving as a platform for the next upwardly adjacent reel. Reverse relative rotation of the topmost reel relative to the next adjacent reel readily effects unlocking thereof.

While only a single lug and key has been mentioned in respect of each reel, it will be understood that, in practice, we equip each reel with three keys and lugs disposed 120° apart circumferentially around the respective rings to which they are secured.

It will be noted that the rings and spokes may be formed of circular stock, preferably tubing, and that the outside diameter of the spoke material is smaller than that of the rings. This enables us to align the inner surface 27 of the legs 14*a* and 14*b* of the spokes with the inner surface 29 of the rings, as shown in FIG. 3, while the outer surface of the spokes is offset inwardly of the outer surface of the rings so that, when stacked, the legs 14*a* of one reel, bear against the ring 11 of the next adjacent reel while the ring 12 of each reel rests partially within the confines of the ring 11 of the next adjacent reel (FIG. 5).

Referring to the support 15 and opening 16 already alluded to, and to FIG. 1, it will be noted that the support 15 comprises a cable guide to which the platform 17 is fixed so as in turn to support a power box 19 for connection to an end of a cable wound within the reel, the opening 16 in the support 15 permitting passage therethrough of a terminal end of the cable to be connected to the power box.

In use, a plurality or reels are stacked, as described. Each reel carries a particular power transmitting cable wound therein, as shown in FIG. 1, with the interior terminal adapted for attachment to a tool, heater or miniature TV camera, for example, and with the outer terminal mounted to an appropriate power coupling. The inner terminal of each cable may be peeled from its reel for use as required. For example, to examine and service the interior of an underground pipe only one end of which is accessible without removing the pipe, a miniature TV camera may be mounted at the inner end of an appropriate cable, the other end of which is coupled to a power supply and closed circuit transmission lines. The camera is then inserted into the pipe to be serviced and its interior examined visually on a remote CRT. After removal of the camera, the pipe may be sealed at a point remote from its access end by employing a second cable to actuate a heater to expand and set a plastic plug. A mechanical power transmission cable may then be used to drive an internal pipe deburring tool or an internal pipe saw to deburr or cut the pipe internally. Numerous other service operations may thus be performed.

When the work is completed, the cables are disconnected from their power source and tools and rewound in their respective reels. The reels are unlocked from adjacent reels by rotating the topmost reel a few degrees relative to the next reel to separate the mating key and lug thereof and the top reel is removed. The procedure is repeated until all reels are removed.

It will be appreciated that the reel of the present invention enables convenient transport of the desired cables to the job site, stable stacking of the reels in a confined space and easy access to the necessary cables.

We believe that the construction and operation of our novel stackable cable reel will now be understood and that the advantages thereof will be fully appreciated by those persons skilled in the art.

We claim:

1. A cable reel adapted to be locked to adjacent similar reels and comprising:

a pair of spaced, concentric and parallel rings;

a plurality of U-shaped spokes, the legs of which are connected respectively to one of said rings and extend outwardly thereof in planes parallel to the planes of the respective rings;

locking means including a key secured to one of said rings and formed with a locking surface and a lug secured to the other of said rings and formed with a locking surface effectively to lock adjacent reels together by bringing said surface of said key on one reel into mating engagement with said surface of said lug on the adjacent reel;

a cable guide formed of an arcuate element having a center of curvature coincident with that of said rings and being semi-tubular in cross-section to correspond to the contour of and be connected at its ends with the bights of two adjacent spokes;

means on said cable guide for supporting a power box or the like for connection to the end of a cable wound in the reel; and said guide having an opening for passage therethrough of a terminal end of cable to be connected to the power box.

2. A cable reel according to claim 1, wherein said locking surfaces are inclined for mating engagement.

3. A cable reel according to claim 1, wherein one of said locking surfaces is grooved and the other is projecting for mating engagement.

4. A cable reel according to any one of claims 1 to 3, wherein said surfaces are inclined at an angle of the order of about 10° to a line tangent to the respective ring to which said key and said lug are attached at the center of the zone of contact thereof, and at an angle of the order of about 30° to the central axis of the reel.

* * * * *

UNITED STATES PATENT AND TRADEMARK OFFICE

CERTIFICATE OF CORRECTION

PATENT NO. : 4,602,752

DATED : July 29, 1986

INVENTOR(S) : HELMUT E. NIMKE, ET. AL.

It is certified that error appears in the above-identified patent and that said Letters Patent is hereby corrected as shown below:

Column 3, lines 51 and 52, "FIGS. 6 and 6" should be --FIG. 6--.

Signed and Sealed this

*Twenty-third* Day of *September 1986*

[SEAL]

*Attest:*

DONALD J. QUIGG

*Attesting Officer*

*Commissioner of Patents and Trademarks*